US008328577B1

(12) United States Patent
Lu

(10) Patent No.: US 8,328,577 B1
(45) Date of Patent: Dec. 11, 2012

(54) COAXIAL CABLE CONNECTOR

(76) Inventor: Yueh Chiung Lu, Tao Yuen Hsien (TW)

( * ) Notice: Subject to any disclaimer, the term of this patent is extended or adjusted under 35 U.S.C. 154(b) by 0 days.

(21) Appl. No.: 13/274,308

(22) Filed: Oct. 15, 2011

(51) Int. Cl.
*H01R 9/05* (2006.01)

(52) U.S. Cl. ..... 439/578

(58) Field of Classification Search ..... 439/578, 439/583–585, 101, 92, 95
See application file for complete search history.

(56) References Cited

U.S. PATENT DOCUMENTS

| | | | | |
|---|---|---|---|---|
| 6,840,803 | B2 * | 1/2005 | Wlos et al. | 439/585 |
| 7,018,235 | B1 * | 3/2006 | Burris et al. | 439/584 |
| 7,029,326 | B2 * | 4/2006 | Montena | 439/585 |
| 7,108,547 | B2 * | 9/2006 | Kisling et al. | 439/578 |
| 7,131,868 | B2 * | 11/2006 | Montena | 439/578 |
| 8,011,955 | B1 | 9/2011 | Lu | |
| 2006/0194474 | A1 * | 8/2006 | Montena | 439/578 |
| 2012/0196476 | A1 * | 8/2012 | Haberek et al. | 439/578 |
| 2012/0202379 | A1 * | 8/2012 | Rodrigues | 439/583 |
| 2012/0214341 | A1 * | 8/2012 | Huang et al. | 439/583 |
| 2012/0225581 | A1 * | 9/2012 | Amidon et al. | 439/584 |

* cited by examiner

*Primary Examiner* — Neil Abrams
*Assistant Examiner* — Phuongchi Nguyen
(74) *Attorney, Agent, or Firm* — Guice Patents PLLC

(57) ABSTRACT

A coaxial cable connector suitable for assembly with one of a series of coaxial cables having one same specification and different wire outer diameters is disclosed to use a plastic bushing for compressing by a barrel to wrap about the coaxial cable and compress an inner tube against the aluminum foil and insulation spacer of the coaxial cable, protecting the coaxial cable against weather and extending the lifespan, an O-ring in a locating groove around a front neck of a body shell or on an annular rear contact face of a screw nut to seal the gap between the screw nut and the body shell, and a curved spring plate for stoppage between an annular front stop face of the body shell and an annular rear contact face of the screw nut for grounding to enhance signal transmission reliability.

6 Claims, 9 Drawing Sheets

COAXIAL CABLE CONNECTOR

BACKGROUND OF THE INVENTION

1. Field of the Invention

The present invention relates to coaxial cable connectors and more particularly, to such a coaxial cable for connecting a coaxial cable to a mating device, for example, cable TV signal line, maintaining excellent signal transmission.

2. Description of the Related Art

U.S. Pat. No. 8,011,955, invented by the present inventor and now allowed for patent, discloses a coaxial cable connector for assembly with one of a series of coaxial cables having one same specification and different wire outer diameters that uses a plastic bushing for compressing by a barrel to wrap about the coaxial cable and compress an inner tube against the aluminum foil and insulation spacer of the coaxial cable, protecting the coaxial cable against weather and extending the lifespan. A short distance is left between the aluminum foil insertion hole on the left end of the inner tube and the left orifice of the barrel, facilitating insertion of the insulation spacer and aluminum foil of the coaxial cable without causing damage.

A coaxial cable connector is adapted for connecting a coaxial cable B to a mating device 8. As shown in FIG. 2, the mating device 8 comprises a base member 81, an F-connector 82 forwardly extended from the front side of the base member 81. The F-connector 82 is externally threaded, having a front contact face 83 and a metal clamp 84 disposed on the inside.

Before fastening up the screw nut 1 of the aforesaid prior art coaxial cable connector with the outer threads of the F-connector 82 of the mating device 8, as shown in FIG. 1 (equivalent to FIG. 9 in the specification of the prior art patent), the face 1*a* of the screw nut 1 is kept apart from the stop face 2*a* of the inner tube 2. The face 1*a* of the screw nut 1 can be kept in positive contact with the stop face 2*a* of the inner tube 2 for grounding only after the screw nut 1 and the F-connector 82 of the mating device 8 have been fastened up tightly. If the screw nut 1 is not fastened tight after installation, or the screw nut 1 is loosed after a long use, noise interference may occur during signal transmission.

To avoid this problem, an improved commercial coaxial cable connector design is known. According to this design, as shown in FIG. 3, a spring plate 90 is set in between the screw nut 91 and inner tube 92 and the main body tube 93. As shown in FIG. 3A, the spring plate 90 is retained between the inner tube 92 and the main body tube 93 and kept in contact with the screw nut 91. Thus, either the screw nut 91 is fastened tight or not, the inner tube 92, the main body tube 93 and the screw nut 91 provide a grounding function. However, the structural arrangement has the drawbacks of high installation cost, low spring force and instable contact. Further, the installation of the spring plate 90 is limited to a particular direction. Further, this spring plate 90 is specially designed, its fabrication cost is high.

SUMMARY OF THE INVENTION

The present invention has been accomplished under the circumstances in view. It is main object of the present invention to provide a coaxial cable connector for assembly with one of a series of coaxial cables having one same specification and different wire outer diameters, which eliminates the drawbacks of the aforesaid various prior art designs.

To achieve this and other objects of the present invention, a coaxial cable connector comprises a screw nut, an inner tube, a body shell, a barrel, a plastic bushing, a curved spring plate and an O-ring. The screw nut comprises an inner thread for threading onto an outer thread of a mating member, a vertically extending annular rear contact face disposed at the rear side thereof, a horizontally extending tubular rear inner face, an inside stop face perpendicularly extended from the front side of the horizontally extending tubular rear inner face in a parallel manner relative to the vertically extending annular rear contact face, and a circular chamfered edge connected between the vertically extending annular rear contact face and the horizontally extending tubular rear inner face. The inner tube is mounted in one end of the screw nut, comprising a rear insertion hole for the insertion of the aluminum foil of a coaxial cable, a barbed engagement portion extending around the periphery thereof remote from the screw nut, an annular front end face radially outwardly extended from the front side thereof, and an annular front stop face disposed in a parallel manner at the back side of the annular front end face. The body shell surrounds the inner tube, comprising a clamping hole axially extending through the opposing front and rear sides thereof, a tubular clamping portion surrounding the clamping hole, an annular front stop face vertically disposed at the front side, a front neck axially forwardly disposed at the front side around the clamping hole, a locating groove extending around the periphery of the front neck, a tapered face radially connected between the front neck and the annular front stop face, and a stop flange extending around a front side of the tubular clamping portion such that the barbed engagement portion of the inner tube suspends outside the tubular clamping portion of the body shell after installation of the inner tube in the screw nut. The barrel is sleeved onto the tubular clamping portion of the body shell and kept away from the stop flange of the shell at a distance before installation of a coaxial cable in the coaxial cable connector, comprising a rear hole defined in the rear side thereof for the insertion of a coaxial cable, a contracted clamping hole defined therein adjacent to the rear hole, and a beveled inner guide face disposed at the front side of the contracted clamping hole. The plastic bushing is set in the barrel, comprising a front inner end edge disposed at the front side thereof and defining with an outer end edge of the barbed engagement portion of the inner tube a gap for receiving the braided outer conductor of the inserted coaxial cable, a rear inner end edge disposed at the rear side thereof and having a diameter fitting the inner diameter of the contracted clamping hole of the barrel, a tapered inside wall gradually reducing in direction from the front side toward the rear side, and a beveled retaining surface extending around the periphery thereof corresponding to the tapered inside wall and sloping downwardly toward the rear side of the plastic bushing, The curved spring plate is mounted around the front neck of the body shell and stopped between the annular front stop face of the body shell and the annular rear contact face of the screw nut for grounding. The O-ring is mounted in the locating groove around the front neck of said body shell and stopped against said tubular rear inner face of the screw nut to seal the gap between the screw nut and the front neck of the body shell.

By means of attaching the curved spring plate to the front neck of the body shell to keep the back face of the curved spring plate in positive contact with the annular rear contact face of the screw nut, the inside stop face of the screw nut can be positively forced into contact with the annular front stop face of the inner tube for grounding when the screw nut and the mating device are fastened together to force the center conductor of the coaxial cable into engagement with the metal clamping plate of the mating device. Even if the inner thread of the screw nut is threaded onto only one thread turn of the outer thread of the F-connector of the mating member, the inner tube and the screw nut can be positively grounded with the mating device, maintaining signal transmission reliability. Further, the curved spring plate is symmetrical and easy and inexpensive to manufacture, and can be installed in either direction to assure a high level of contact stability.

In an alternate form of the present invention, the O-ring can be mounted in a locating groove on an annular rear contact face at the rear side of the screw nut and stopped against the periphery of the front neck of the body shell to seal the gap between the screw nut and the front neck of the body shell.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
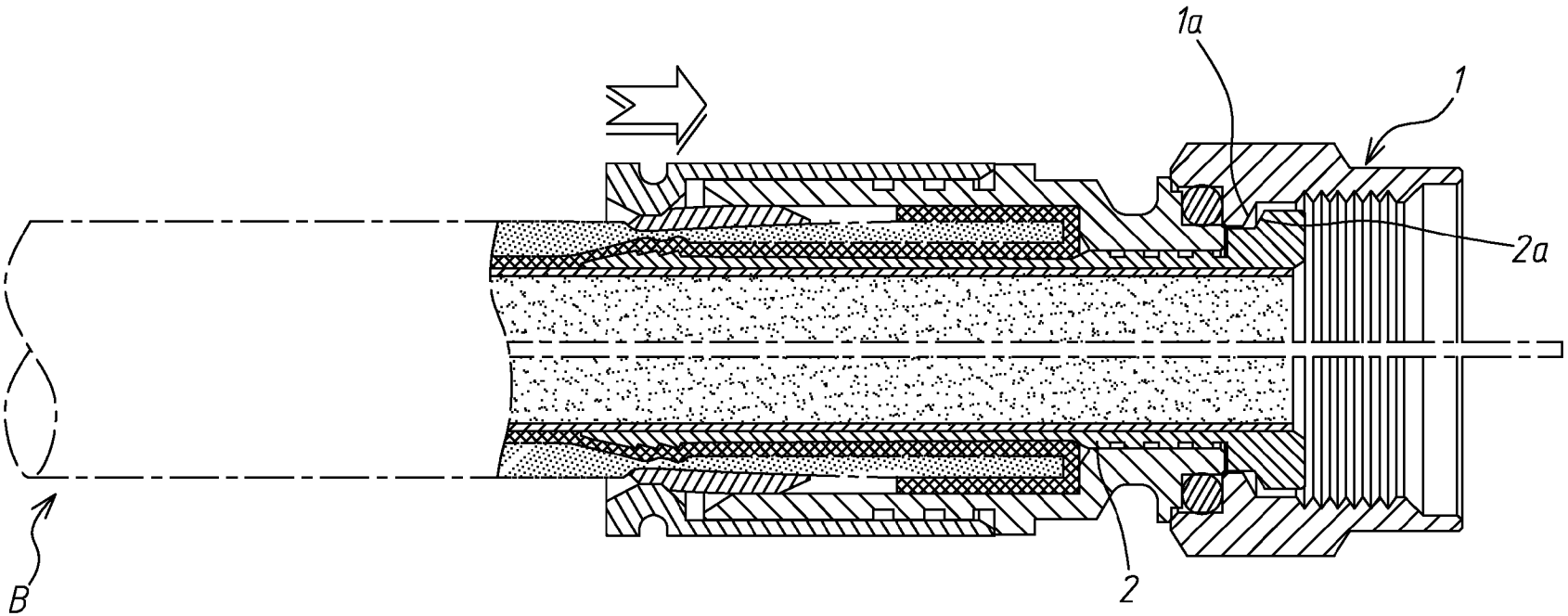
FIG. 1 Prior Art
FIG. 1 is a sectional view of a coaxial cable connector before installation of a coaxial cable according to the prior art.
Figure 2:
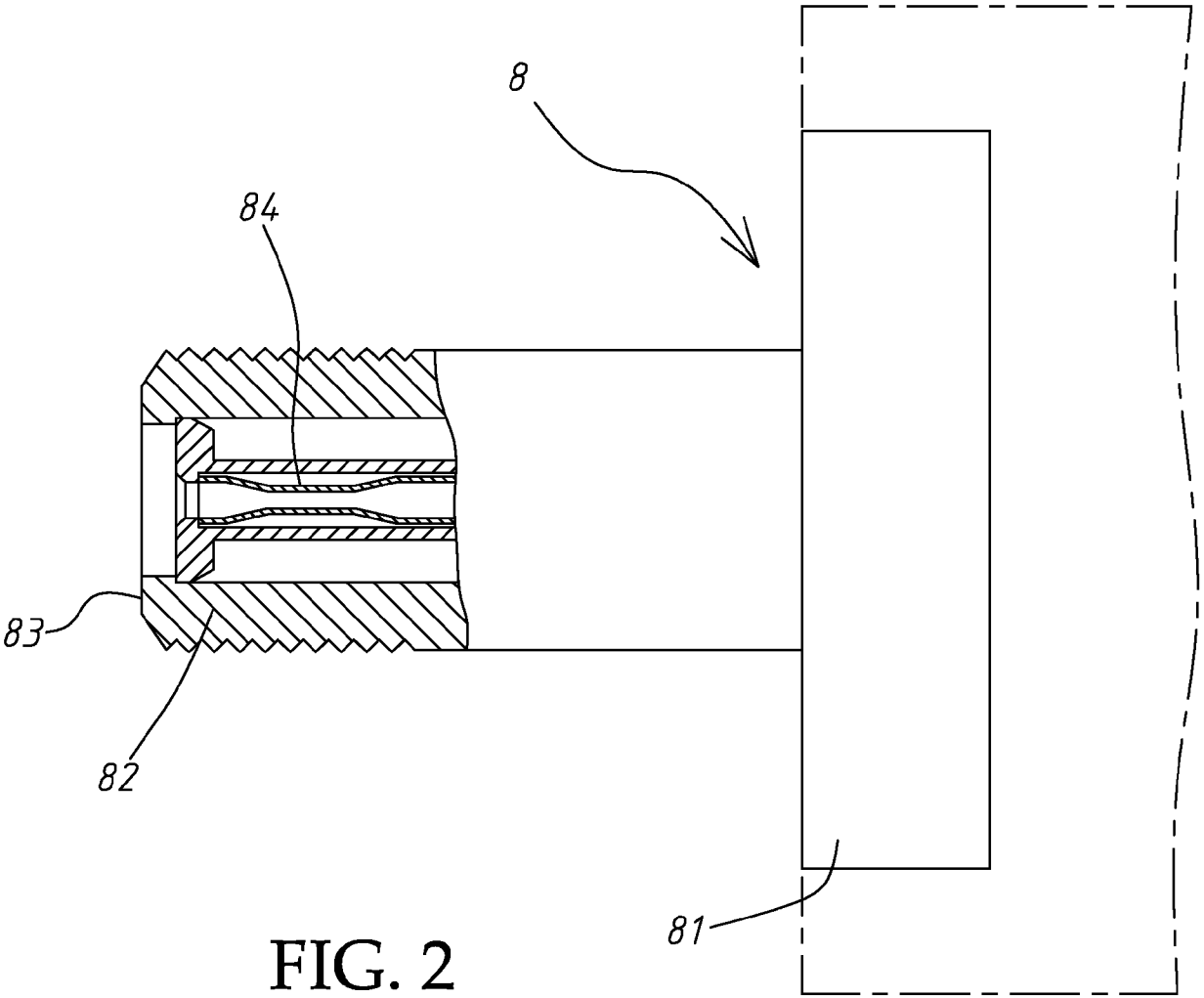
FIG. 2 Prior Art
FIG. 2 is a sectional view of a mating device for use with the coaxial cable connector according to the prior art.
Figure 3B:
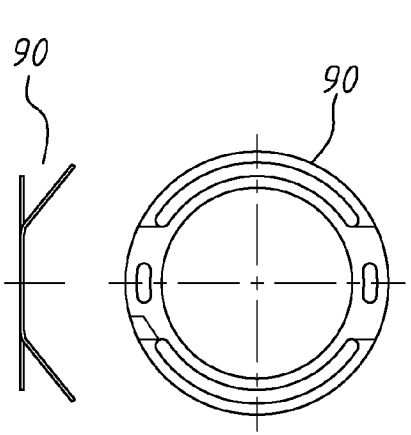
FIG. 3B Prior Art
FIG. 3B is front and side views of the spring plate of the coaxial cable connector according to the prior art.
Figure 3A:
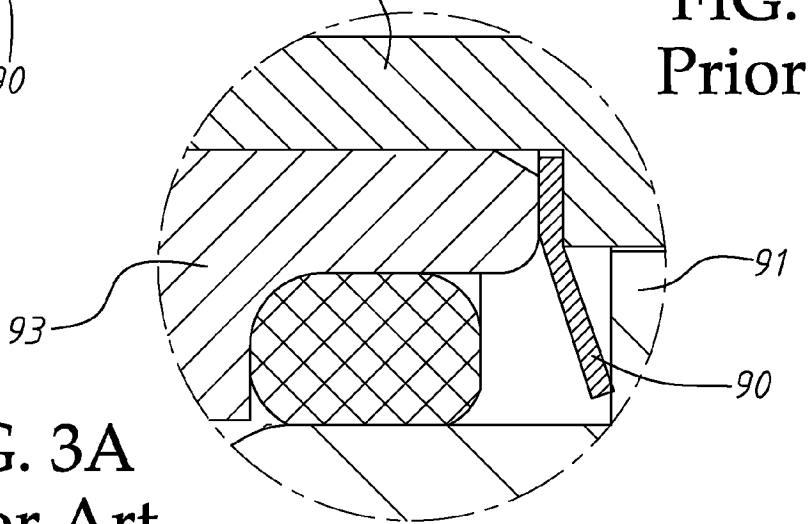
FIG. 3A Prior Art
FIG. 3A is an enlarged view of part A of FIG. 3.
Figure 3:
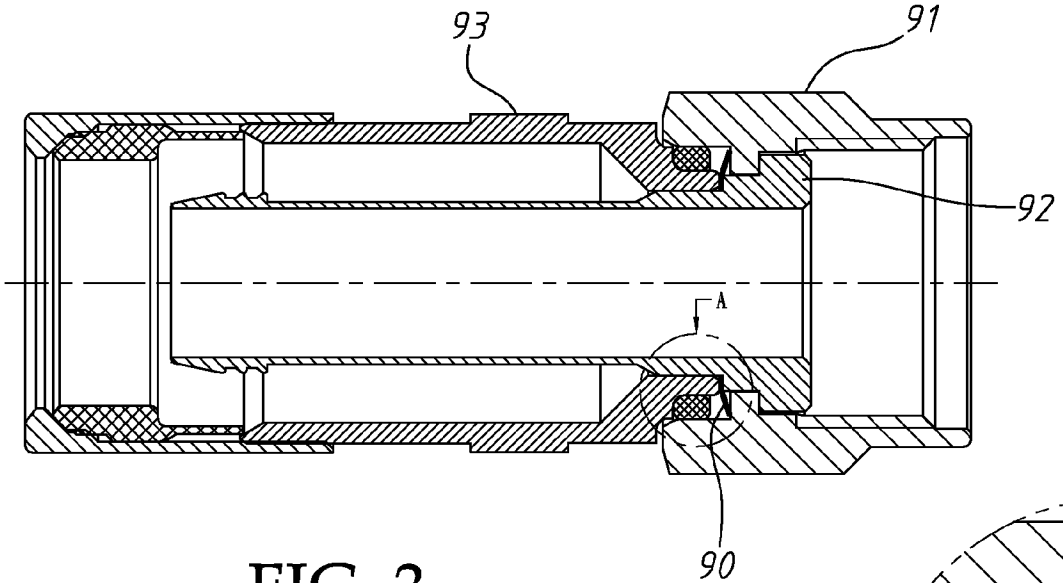
FIG. 3 Prior Art
FIG. 3 is a sectional view of another design of coaxial cable connector according to the prior art.
Figure 4:
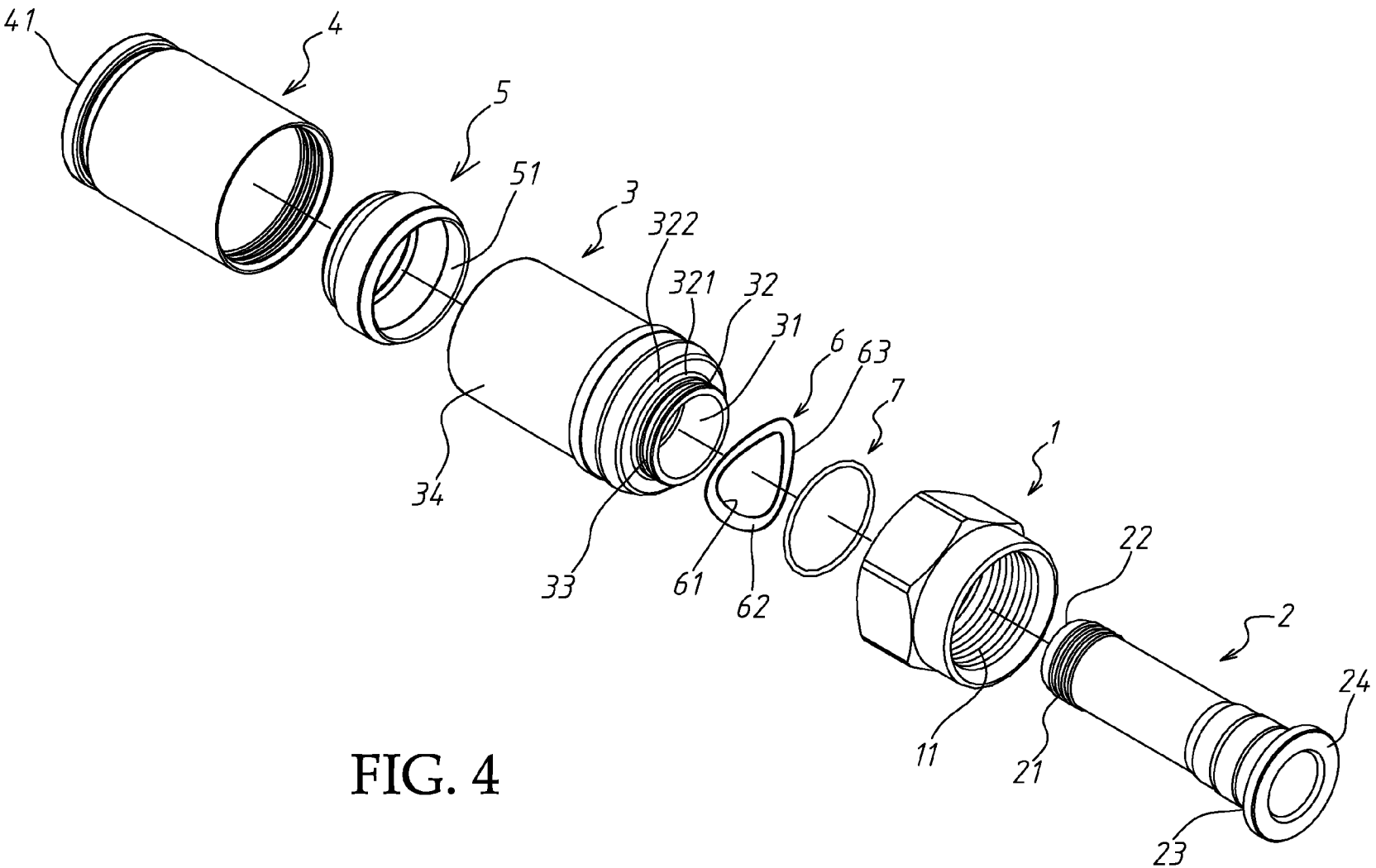
FIG. 4 is an exploded view of a coaxial cable connector in accordance with the present invention.
Figure 5:
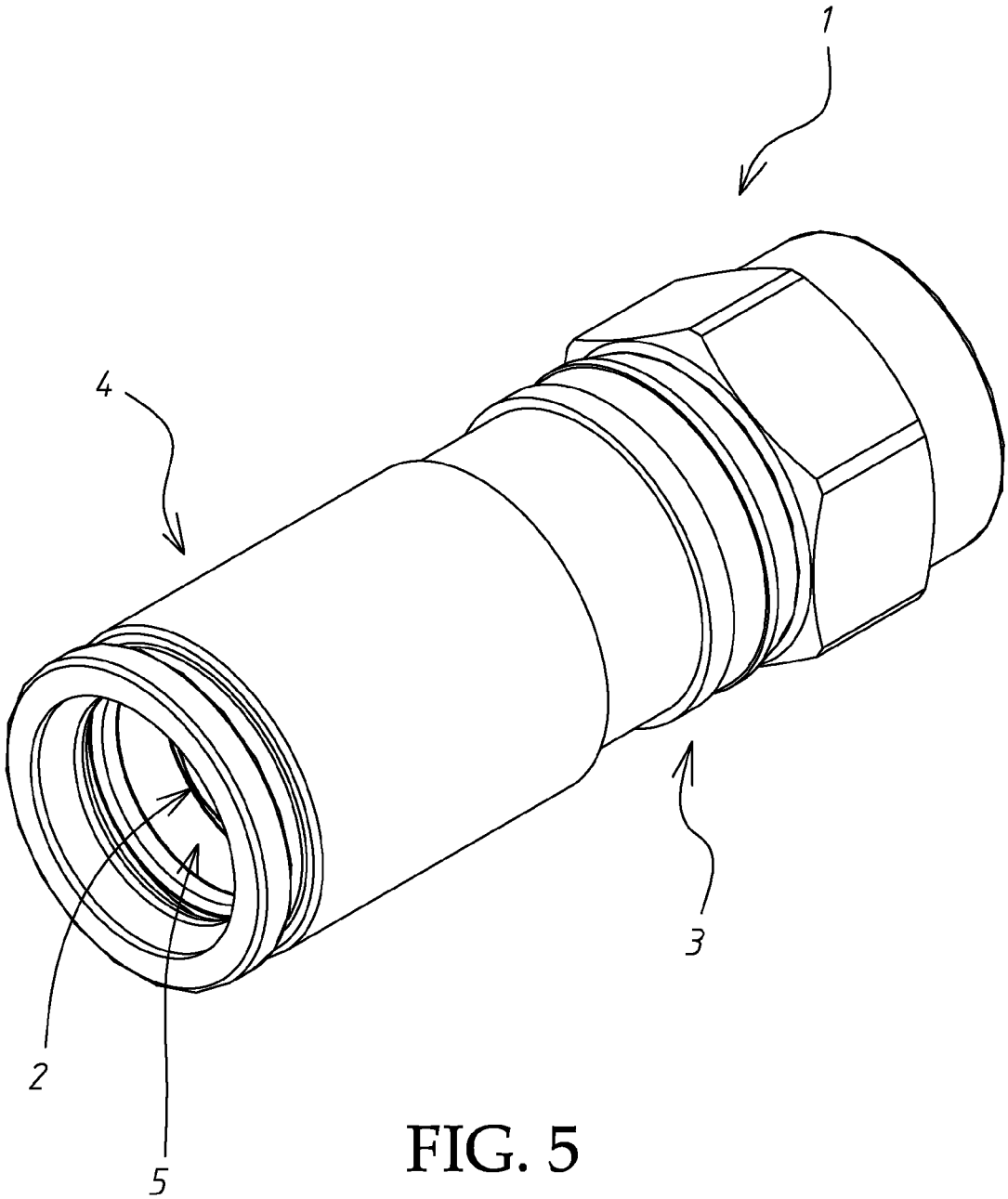
FIG. 5 is an elevational view of the coaxial cable connector in accordance with the present invention.

Referring to FIGS. 4~7, a coaxial cable connector in accordance with a first embodiment of the present invention is substantially similar to "Coaxial cable connector" of U.S. patent application Ser. No. 13/015,572, and adapted for connecting a coaxial cable to a mating device (see FIG. 2). The coaxial cable connector comprises a screw nut 1, an inner tube 2, a body shell 3, a barrel 4, a plastic bushing 5, a curved spring plate 6 and an O-rig 7.

Figure 6:
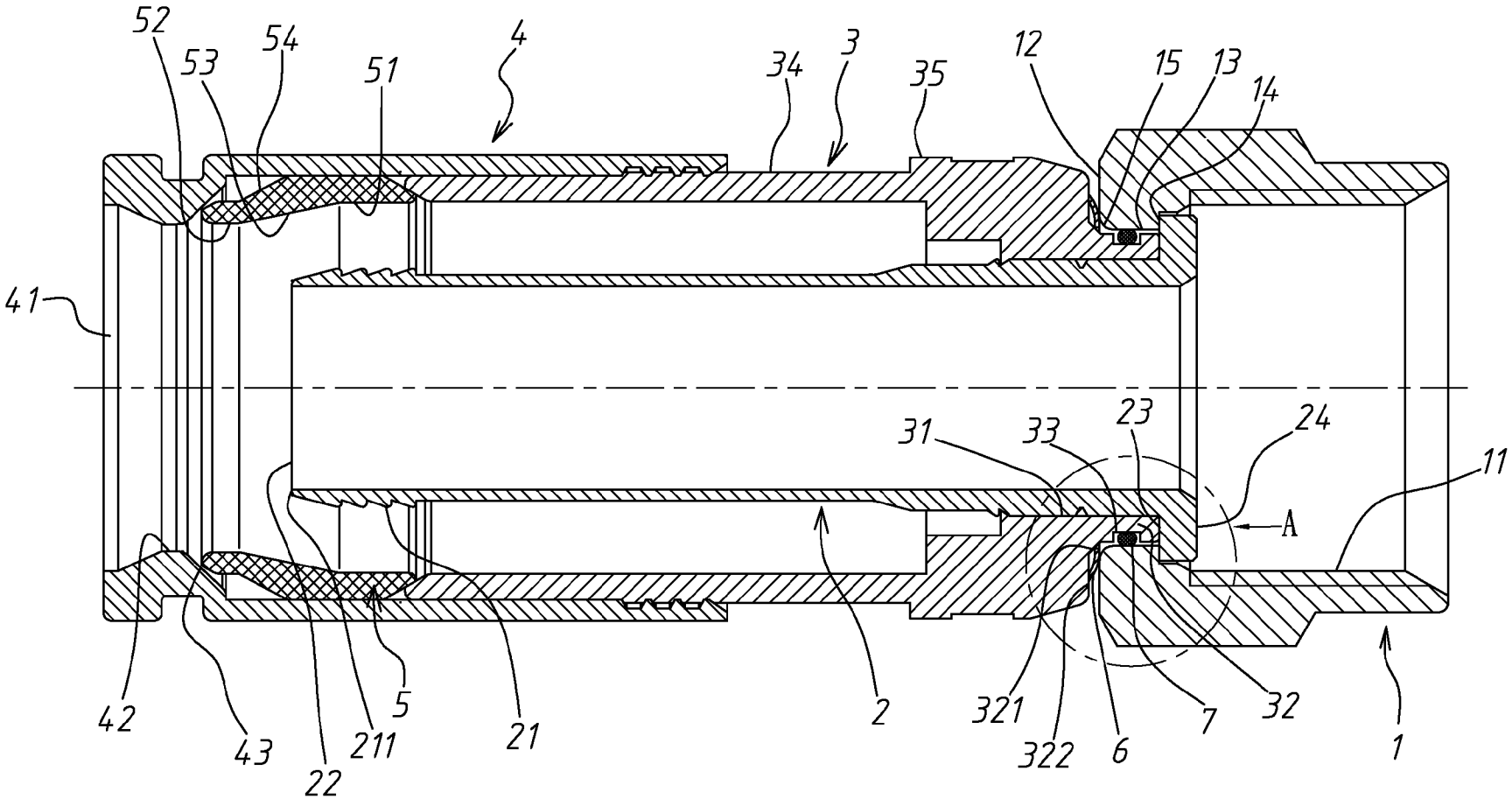
FIG. 6 is a sectional view of the coaxial cable connector in accordance with the present invention.
Figure 7:
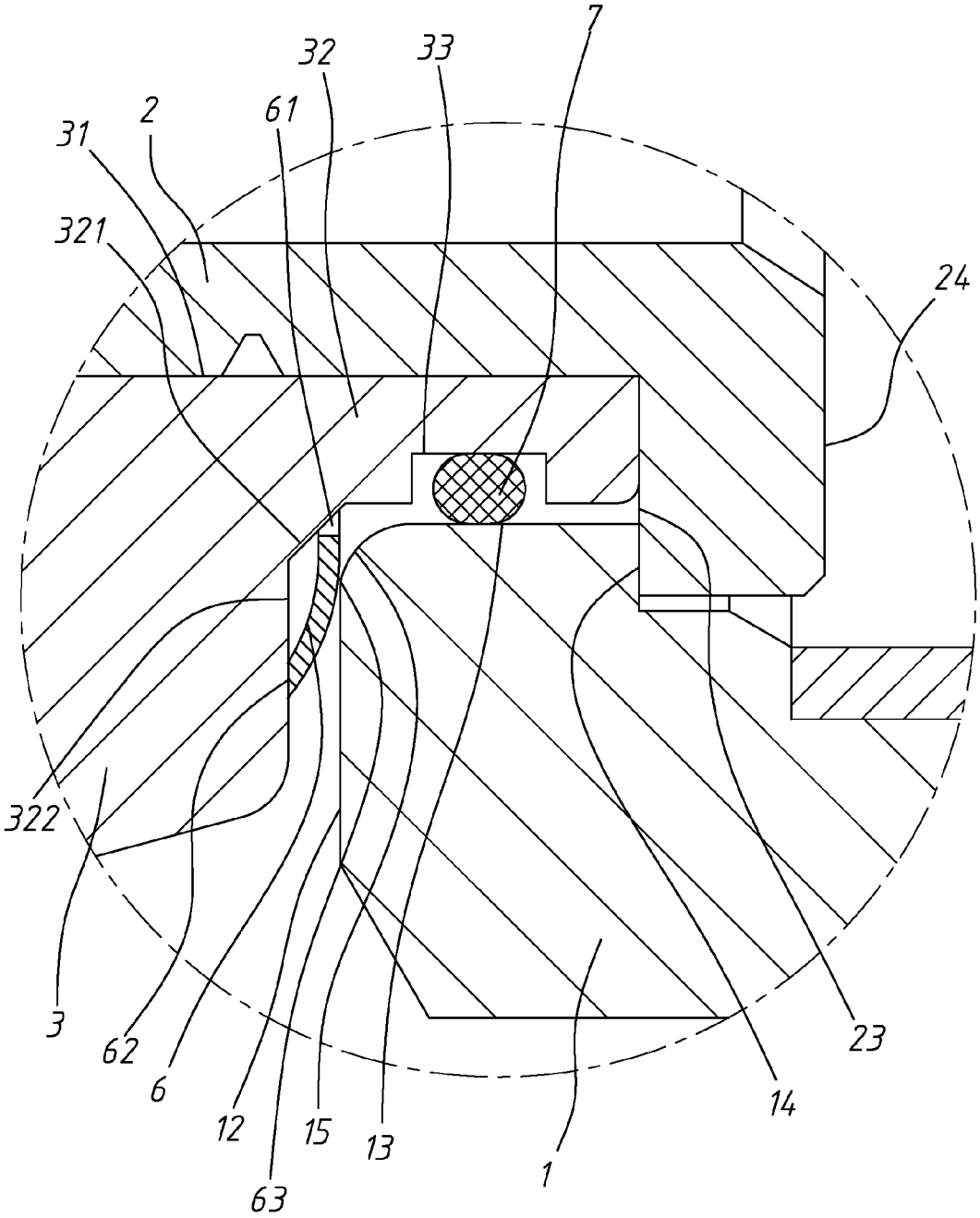
FIG. 7 is an enlarged view of part A of FIG. 6.

The screw nut 1 comprises an inner thread 11 for threading onto an outer thread of a F-connector 82 of a mating member 8 (see FIG. 2), a vertically (radially) extending annular rear contact face 12 disposed at the rear side thereof, as shown in FIGS. 6 and 7, a horizontally (axially) extending tubular rear inner face 13, an inside stop face 14 perpendicularly extended from the front side of the horizontally (axially) extending tubular rear inner face 13 in a parallel manner relative to the vertically (radially) extending annular rear contact face 12, and a circular chamfered edge 15 connected between the vertically (radially) extending annular rear contact face 12 and the horizontally (axially) extending tubular rear inner face 13.

The inner tube 2 is mounted in one end of the screw nut 1, comprising a rear insertion hole 22 for the insertion of the aluminum foil of a coaxial cable (not shown), a rear end edge 211 disposed at the rear side thereof and surrounding the rear insertion hole 22, a barbed engagement portion 21 extending around the periphery and abutted against the rear end edge 211, an annular front end face 24 radially outwardly extended from the front side thereof, and an annular front stop face 23 disposed in a parallel manner at the back side of the annular front end face 24.

The body shell 3 surrounds the inner tube 2. Further, the body shell 3 can be prepared from plastics or metal, comprising a clamping hole 31 axially extending through opposing front and rear sides thereof, a tubular clamping portion 34 surrounding the clamping hole 31, an annular front stop face 322 vertically (radially) disposed at the front side, a front neck 32 axially forwardly disposed at the front side around the clamping hole 31, a locating groove 33 extending around the periphery of the front neck 32, a tapered face 321 radially connected between the front neck 32 and the annular front stop face 322, and a stop flange 35 extending around the front side of the tubular clamping portion 34. After installation of the inner tube 2 in the screw nut 1, the barbed engagement portion 21 suspending outside the tubular clamping portion 34 of the body shell 3.

The barrel 4 is sleeved onto the tubular clamping portion 34 of the body shell 3. Before installation of a coaxial cable in the coaxial cable connector, the barrel 4 is kept away from the stop flange 35 at a distance. Further, the barrel 4 comprises a rear hole 41 defined in the rear side thereof for the insertion of a coaxial cable, a contracted clamping hole 42 defined therein adjacent to the rear hole 41 (see FIG. 6), and a beveled inner guide face 43 disposed at the front side of the contracted clamping hole 42.

The plastic bushing 5 is set in the barrel 4, leaving a large gap in between an inner end edge 51 of the front side thereof and the outer end edge of the barbed engagement portion 21 of the inner tube 2 for receiving the braided outer conductor (of standard, tri-shield or quad-shield design) of the inserted coaxial cable. By means of the elastically deformable material property, the protective plastic covering of the coaxial cable can be positively surrounded by the plastic bushing 5 to compress the barbed engagement portion 21 of the inner tube 2, enhancing engagement between the barbed engagement portion 21 of the inner tube 2 and the braided outer conductor of the coaxial cable and sealing the gap against outside moisture. The inner end edge 52 of the rear side of the plastic bushing 5 has a diameter fitting the inner diameter of the contracted clamping hole 42 of the barrel 4. The plastic bushing 5 further has a tapered inside wall 53 gradually reducing in direction from the front side toward the rear side, and a beveled retaining surface 54 extending around the periphery corresponding to the tapered inside wall 53 and sloping downwardly toward the rear side of the plastic bushing.

The main feature of the present invention is the use of the curved spring plate 6. The curved spring plate 6 is mounted around the front neck 32 of the body shell 3, having an inner edge 61 attached to the tapered face 321 at the back side of the front neck 32, a front face 62 stopped against the annular front stop face 322 of the body shell 3 and a back face 63 stopped against the annular rear contact face 12 of the screw nut 1 to impart a pressure to the screw nut 1, keeping the inside stop face 14 of the screw nut 1 in positive contact with the annular front stop face 23 of the inner tube 2 for grounding. Thus, after the screw nut 1 is threaded onto the outer thread of the F-connector 82 of the mating device 8, the screw nut 1 and the inner tube 2 are grounded with the metal shell of the F-connector 82, maintaining signal transmission reliability.

By means of attaching the curved spring plate 6 to the front neck 32 of the body shell 3 to keep the back face 63 of the curved spring plate 6 in positive contact with the annular rear contact face 12 of the screw nut 1 (either the screw nut 1 is fastened tight with the mating device 8 or not), the inside stop face 14 of the screw nut 1 can be positively forced into contact with the annular front stop face 23 of the inner tube 2 for grounding when the screw nut 1 and the mating device 8 are fastened together to force the center conductor of the coaxial cable into engagement with the metal clamping plate 84 of the mating device 8. Even if the inner thread 11 of the screw nut 1 is threaded onto only one thread turn of the outer thread of the F-connector 82 of the mating member 8, the inner tube 2 and the screw nut 1 can be positively grounded with the mating device 8, maintaining signal transmission reliability. When comparing to the arrangement of the spring plate between the main body tube and the inner tube of the aforesaid prior art design, the curved spring plate 6 is easier to install and relatively cheaper.

Further, as shown in FIG. 7, the O-ring 7 is mounted in the locating groove 33 around the front neck 32 of the body shell 3 and stopped against the tubular rear inner face 13 of the screw nut 1 to seal the gap between the screw nut 1 and the front neck 32 of the body shell 3, providing excellent waterproof function.

Figure 8:
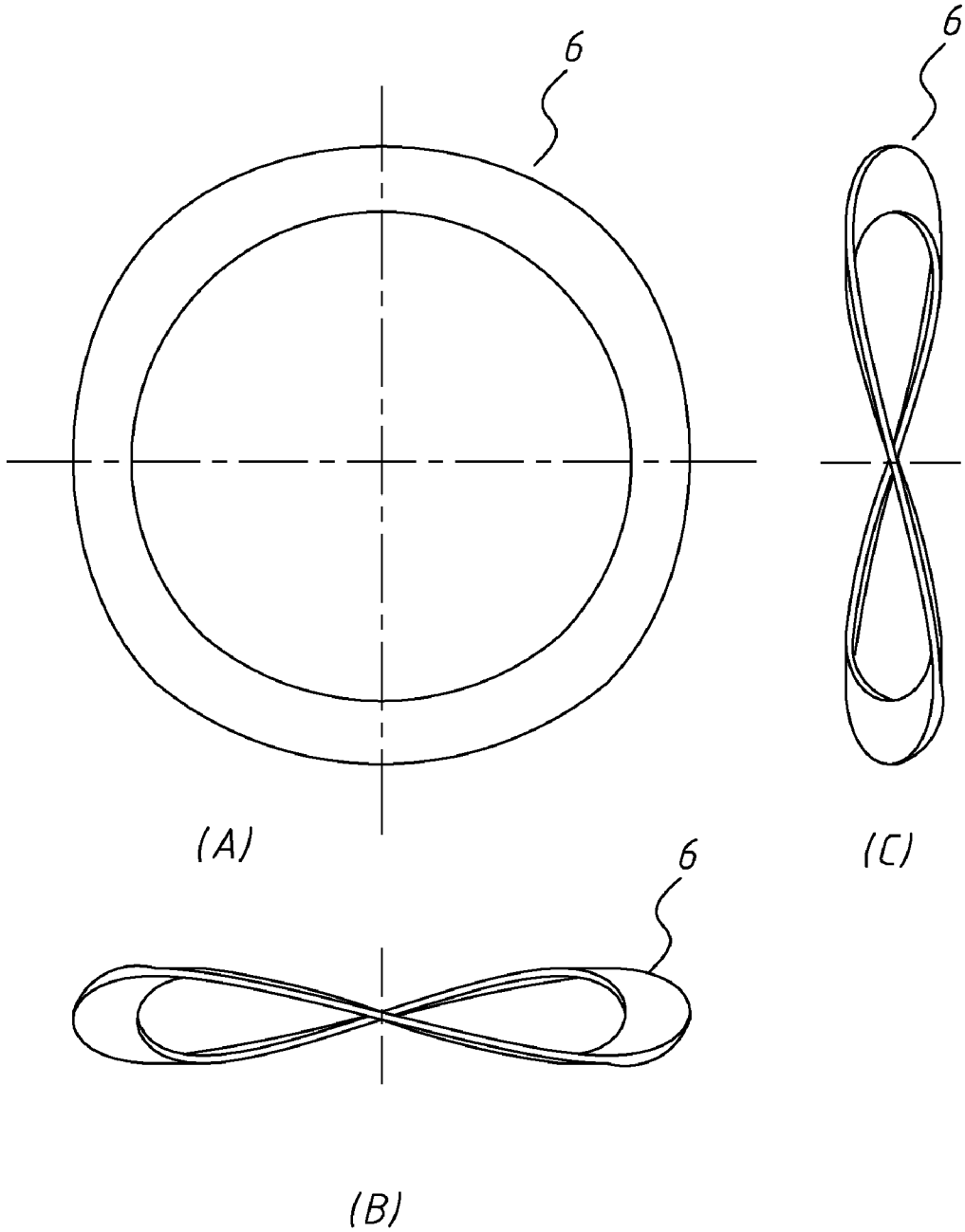
FIG. 8 is front plain view (A), left side view (B) and right side view (C) of the curved spring plate of the coaxial cable connector in accordance with the present invention.

Referring to FIG. 8, the curved spring plate 6 exhibits a substantially 8-shaped configuration when viewed from the left or right side. This design of curved configuration enables the curved spring plate 6 to be kept in positive contact with the inside stop face 14 of the screw nut 1 and the annular front stop face 23 of the inner tube 2. However, it is to be noted that this 8-shaped configuration is not a limitation. Any equivalent spring plate design can be used as a substitute.

As stated above, the curved spring plate 6 is directly attached the front neck 32 of the body shell 3 during installation. When compared to the prior art design to set the spring plate between the main body tube and the inner tube, the installation of the curved spring plate 6 is easy. Further, the curved spring plate 6 is relatively cheaper when compared to the prior art design. Further, the curved spring plate 6 can be kept in positive contact with the related component parts.

Figure 9:
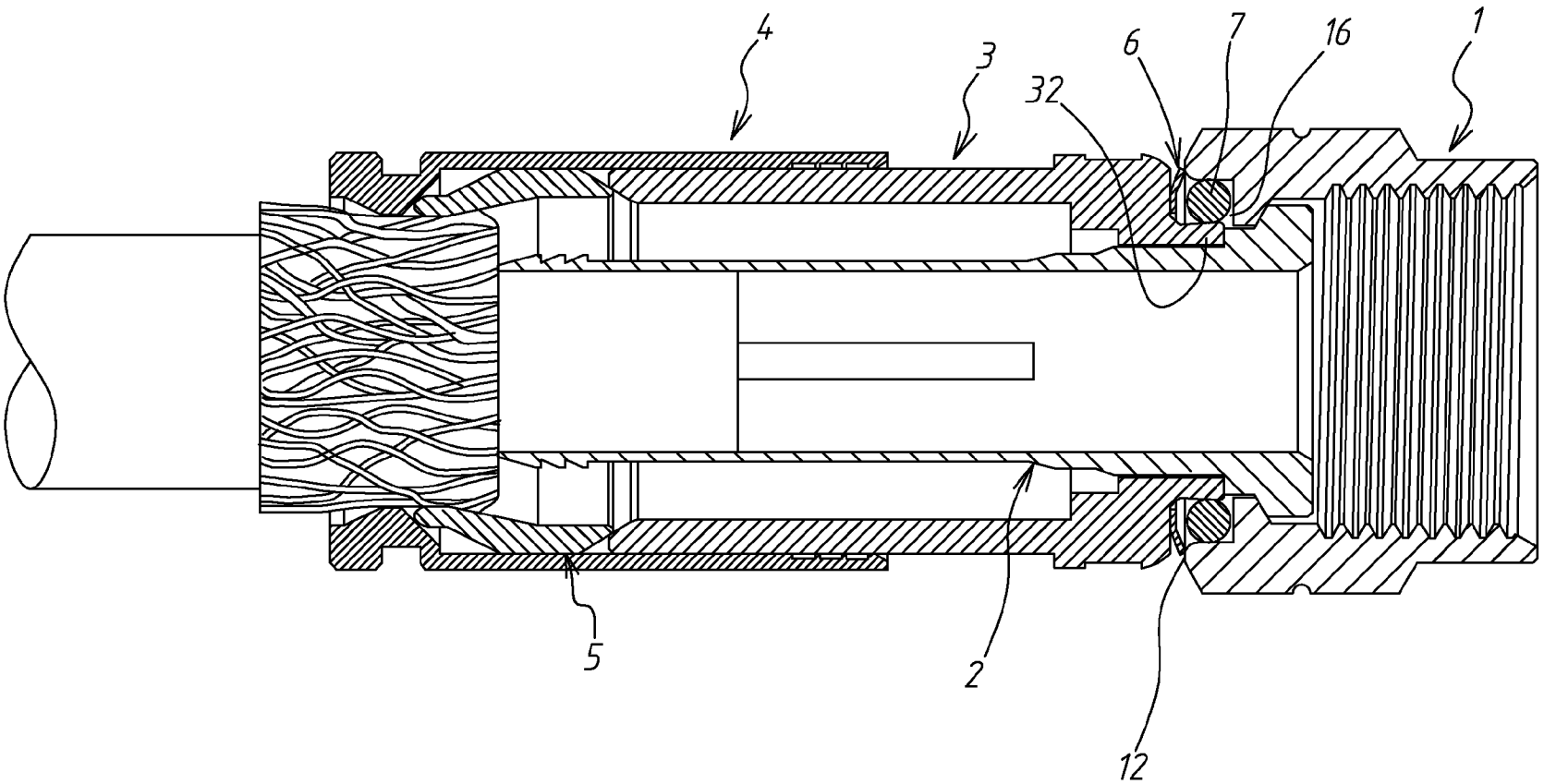
FIG. 9 is a sectional view of another alternate form of the coaxial cable connector in accordance with the present invention.

FIG. 9 illustrates a coaxial cable connector in accordance with a second embodiment of the present invention. Similar to the aforesaid first embodiment, the coaxial cable connector of this second embodiment comprises a screw nut 1, an inner tube 2, a body shell 3, a barrel 4, a plastic bushing 5, a curved spring plate 6 and an O-rig 7. This second embodiment eliminates the aforesaid locating groove 33 from the front neck 32 of the body shell 3 and has a locating groove 16 made on the annular rear contact face 12 of the screw nut 1 for accommodating the O-ring 7 to have the O-ring 7 be stopped against the periphery of the front neck 32 of the body shell 3. As the locating groove 16 is made on the annular rear contact face 12 of the screw nut 1, its size can be relatively greater than the locating groove 33 on the front neck 32 of the body shell 3 of the aforesaid first embodiment, enhancing the waterproof effect.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A coaxial cable connector, comprising:

a screw nut comprising an inner thread for threading onto an outer thread of a mating member, a vertically extending annular rear contact face disposed at a rear side thereof, a horizontally extending tubular rear inner face, an inside stop face perpendicularly extended from a front side of said horizontally extending tubular rear inner face in a parallel manner relative to said vertically extending annular rear contact face, and a circular chamfered edge connected between said vertically extending annular rear contact face and said horizontally extending tubular rear inner face;

an inner tube mounted in one end of said screw nut, said inner tube comprising a rear insertion hole for the insertion of the aluminum foil of a coaxial cable, a barbed engagement portion extending around the periphery thereof remote from said screw nut, an annular front end face radially outwardly extended from a front side thereof, and an annular front stop face disposed in a parallel manner at a back side of said annular front end face;

a body shell surrounding said inner tube, said body shell comprising a clamping hole axially extending through opposing front and rear sides thereof, a tubular clamping portion surrounding said clamping hole, an annular front stop face vertically disposed at the front side, a front neck axially forwardly disposed at the front side around said clamping hole, a locating groove extending around the periphery of said front neck, a tapered face radially connected between said front neck and said annular front stop face, and a stop flange extending around a front side of said tubular clamping portion such that said barbed engagement portion of said inner tube suspends outside said tubular clamping portion of said body shell after installation of said inner tube in said screw nut;

a barrel sleeved onto the tubular clamping portion of said body shell and kept away from said stop flange of said shell at a distance before installation of a coaxial cable in the coaxial cable connector, said barrel comprising a rear hole defined in a rear side thereof for the insertion of a coaxial cable, a contracted clamping hole defined therein adjacent to said rear hole, and a beveled inner guide face disposed at a front side of said contracted clamping hole;

a plastic bushing set in said barrel, said plastic bushing comprising a front inner end edge disposed at a front side thereof and defining with an outer end edge of said barbed engagement portion of said inner tube a gap for receiving the braided outer conductor of the inserted coaxial cable, a rear inner end edge disposed at a rear side thereof and having a diameter fitting the inner diameter of said contracted clamping hole of said barrel, a tapered inside wall gradually reducing in direction from the front side toward the rear side, and a beveled retaining surface extending around the periphery thereof corresponding to said tapered inside wall and sloping downwardly toward the rear side of said plastic bushing;

a curved spring plate mounted around said front neck of said body shell and stopped between said annular front stop face of said body shell and said annular rear contact face of said screw nut for grounding; and an O-ring mounted in said locating groove around said front neck of said body shell and stopped against said tubular rear inner face of said screw nut to seal the gap between said screw nut and said front neck of said body shell.

2. The coaxial cable connector as claimed in claim 1, wherein said curved spring plate exhibits an 8-shaped configuration when viewed from one lateral side.

3. The coaxial cable connector as claimed in claim 1, wherein said curved spring plate comprises an inner edge attached to the tapered face of said body shell, a front face stopped against said annular front stop face of said body shell and a back face stopped against said annular rear contact face of said screw nut.

4. A coaxial cable connector, comprising:

a screw nut comprising an inner thread for threading onto an outer thread of a mating member, a vertically extending annular rear contact face disposed at a rear side thereof, a horizontally extending tubular rear inner face, an inside stop face perpendicularly extended from a front side of said horizontally extending tubular rear inner face in a parallel manner relative to said vertically extending annular rear contact face, a circular chamfered edge connected between said vertically extending annular rear contact face and said horizontally extending tubular rear inner face, and a locating groove located on said annular rear contact face;

an inner tube mounted in one end of said screw nut, said inner tube comprising a rear insertion hole for the insertion of the aluminum foil of a coaxial cable, a barbed engagement portion extending around the periphery thereof remote from said screw nut, an annular front end face radially outwardly extended from a front side thereof, and an annular front stop face disposed in a parallel manner at a back side of said annular front end face;

a body shell surrounding said inner tube, said body shell comprising a clamping hole axially extending through opposing front and rear sides thereof, a tubular clamping portion surrounding said clamping hole, an annular front stop face vertically disposed at the front side, a front neck axially forwardly disposed at the front side around said clamping hole, a tapered face radially connected between said front neck and said annular front stop face, and a stop flange extending around a front side of said tubular clamping portion such that said barbed engagement portion of said inner tube suspends outside said tubular clamping portion of said body shell after installation of said inner tube in said screw nut;

a barrel sleeved onto the tubular clamping portion of said body shell and kept away from said stop flange of said shell at a distance before installation of a coaxial cable in the coaxial cable connector, said barrel comprising a rear hole defined in a rear side thereof for the insertion of a coaxial cable, a contracted clamping hole defined therein adjacent to said rear hole, and a beveled inner guide face disposed at a front side of said contracted clamping hole;

a plastic bushing set in said barrel, said plastic bushing comprising a front inner end edge disposed at a front side thereof and defining with an outer end edge of said barbed engagement portion of said inner tube a gap for receiving the braided outer conductor of the inserted coaxial cable, a rear inner end edge disposed at a rear side thereof and having a diameter fitting the inner diameter of said contracted clamping hole of said barrel, a tapered inside wall gradually reducing in direction from the front side toward the rear side, and a beveled retaining surface extending around the periphery thereof corresponding to said tapered inside wall and sloping downwardly toward the rear side of said plastic bushing;

a curved spring plate mounted around said front neck of said body shell and stopped between said annular front stop face of said body shell and said annular rear contact face of said screw nut for grounding; and an O-ring mounted in said locating groove on said annular rear contact face of said screw nut and stopped against the periphery of said front neck of said body shell to seal the gap between said screw nut and said front neck of said body shell.

5. The coaxial cable connector as claimed in claim 4, wherein said curved spring plate exhibits an 8-shaped configuration when viewed from one lateral side.

6. The coaxial cable connector as claimed in claim 5, wherein said curved spring plate comprises an inner edge attached to the tapered face of said body shell, a front face stopped against said annular front stop face of said body shell and a back face stopped against said annular rear contact face of said screw nut.

* * * * *